US011771134B2

(12) United States Patent
Chen et al.

(10) Patent No.: US 11,771,134 B2
(45) Date of Patent: Oct. 3, 2023

(54) ATOMIZER OF ELECTRONIC CIGARETTE HAVING DRY-WET SEPARATION COMPONENT

(71) Applicant: SHENZHEN YOUME INFORMATION TECHNOLOGY CO., LTD, Guangdong (CN)

(72) Inventors: Chaoxian Chen, Guangdong (CN); Furong Huang, Guangdong (CN)

(73) Assignee: SHENZHEN YOUME INFORMATION TECHNOLOGY CO., LTD, Guangdong (CN)

( * ) Notice: Subject to any disclaimer, the term of this patent is extended or adjusted under 35 U.S.C. 154(b) by 687 days.

(21) Appl. No.: 16/960,262

(22) PCT Filed: Aug. 29, 2019

(86) PCT No.: PCT/CN2019/103377

§ 371 (c)(1),
(2) Date: Jul. 6, 2020

(87) PCT Pub. No.: WO2020/258501

PCT Pub. Date: Dec. 30, 2020

(65) Prior Publication Data

US 2021/0106062 A1 Apr. 15, 2021

(30) Foreign Application Priority Data

Jun. 26, 2019 (CN) ..... 201910563054.1

(51) Int. Cl.
*A24F 40/485* (2020.01)
*A24F 40/10* (2020.01)
*A24F 40/42* (2020.01)

(52) U.S. Cl.
CPC ..... *A24F 40/485* (2020.01); *A24F 40/10* (2020.01); *A24F 40/42* (2020.01)

(58) Field of Classification Search
CPC ..... A24F 40/485; A24F 40/10; A24F 40/42; A24F 40/40
See application file for complete search history.

(56) References Cited

U.S. PATENT DOCUMENTS 10,791,763 B2 * 10/2020 Chen ..... A24F 40/42
11,160,940 B2 * 11/2021 Rogan ..... A24F 40/40
(Continued)

FOREIGN PATENT DOCUMENTS

CN 104687255 A 6/2015
CN 106108120 A 11/2016
(Continued)

OTHER PUBLICATIONS

Patent Cooperation Treaty: International Search Report for PCT/C2019/103377; dated Mar. 18, 2020; 8 pages.

*Primary Examiner* — Hae Moon Hyeon

(57) ABSTRACT

The present disclosure relates to an atomizer and an electronic cigarette. The atomizer includes a housing, an atomization component, a base and a dry-wet separation component. An internal space of the housing is divided into an e-liquid storage chamber and an atomization chamber. The atomization component is provided inside the atomization chamber. The dry-wet separation component is provided inside the housing; one end of the dry-wet separation component is fixed to the base, the dry-wet separation component is capable of stretching and contracting in a direction perpendicular to the base. The atomization component is not in communication with or is in communication with the e-liquid storage chamber along with stretching and contracting of the dry-wet separation component.

10 Claims, 5 Drawing Sheets

(56) References Cited

U.S. PATENT DOCUMENTS

| | | | | |
|---|---|---|---|---|
| 11,181,199 | B2 * | 11/2021 | Fornarelli | F16K 1/46 |
| 2016/0183597 | A1 * | 6/2016 | Li | H05B 1/0244 392/404 |
| 2017/0156408 | A1 * | 6/2017 | Li | A24F 40/40 |
| 2018/0000156 | A1 * | 1/2018 | Qiu | A24F 40/40 |
| 2020/0146351 | A1 * | 5/2020 | Rogan | A24F 40/42 |
| 2020/0187562 | A1 * | 6/2020 | Rogan | A24F 40/485 |
| 2023/0053550 | A1 * | 2/2023 | Yang | A24F 40/10 |

FOREIGN PATENT DOCUMENTS

| | | | |
|---|---|---|---|
| CN | 205695689 | U | 11/2016 |
| CN | 109330038 | A | 2/2019 |
| CN | 210017868 | U | 2/2020 |
| WO | 2016033721 | A1 | 3/2016 |
| WO | 2016127468 | A1 | 8/2016 |

* cited by examiner

ATOMIZER OF ELECTRONIC CIGARETTE HAVING DRY-WET SEPARATION COMPONENT

CROSS-REFERENCE TO RELATED APPLICATIONS

This application is a U.S. National Phase application submitted under 35 U.S.C. § 371 of Patent Cooperation Treaty application serial no. PCT/CN2019/103377, filed Aug. 29, 2019, and entitled ATOMIZER AND ELECTRONIC CIGARETTE, which application claims priority to Chinese patent application serial no. 201910563054.1, filed Jun. 26, 2019. Patent Cooperation Treaty application serial no. PCT/CN2019/103377 and Chinese patent application serial no. 201910563054.1, are incorporated herein by reference.

TECHNICAL FIELD

The disclosure relates to a technical field of an alternative to cigarettes, and particularly to an atomizer and an electronic cigarette.

BACKGROUND

The electronic cigarette is an electronic product that imitates the cigarette, with the similar smoke, taste and feel to the cigarette. The harmful ingredients in tobacco can enter the user's body with smoking, which can adversely affect the health of the user and people around him. However, in the electronic cigarette, smoke is produced by heating and atomizing an electronic cigarette liquid (e-liquid) made from chemical substances and various flavoring agents, and a nicotine content is controlled by controlling the composition of the e-liquid. Therefore, the electronic cigarette, which is mainly used for quitting smoking and replacing cigarettes, has been rapidly popularized.

The existing electronic cigarette mainly includes two parts: an atomizer and a battery host. The atomizer is a smoke generating device of the electronic cigarette; and the battery host is a control device of the electronic cigarette. After the atomizer is plugged into the battery host, the electronic cigarette can be smoked when it is powered on. Specifically, the atomizer includes an atomization component, an e-liquid storage chamber and an airflow channel. The airflow channel penetrates the atomization component. An atomization chamber of the atomization component is in communication with the e-liquid storage chamber through an e-liquid guiding element of the atomization component. When the e-liquid storage chamber is filled with the e-liquid, the e-liquid is exported through the e-liquid guiding element for high-temperature atomization.

For a pre-e-liquid-filled atomizer, that is, an atomizer which is transported, stored and sold after being filled with the e-liquid, during the transportation and high-temperature storage, changes in the temperature and intensity of pressure can increase the fluidity of the e-liquid in the e-liquid storage chamber; accordingly, a large amount of e-liquid quickly leaks into the atomization chamber through the e-liquid guiding element, and then flows to the outside of the atomizer through an air inlet or an air outlet, causing e-liquid leakage in the atomizer and affecting use.

SUMMARY

Based on this, it is necessary to provide an atomizer and an electronic cigarette which can effectively prevent smoke liquid from leaking out of the atomizer during high-temperature storage and low-pressure transportation with a simple structure.

An atomizer includes a housing, an atomization component and a base, the housing includes an opening and a mouthpiece, an internal space of the housing is divided by a spacer into an electronic cigarette liquid (e-liquid) storage chamber and an atomization chamber, the base is plugged into the opening of the housing, the atomization component is provided inside the atomization chamber, the spacer is provided with a first e-liquid guiding hole, the atomization component is in communication with the first e-liquid guiding hole; the atomizer further includes a dry-wet separation component provided inside the housing, one end of the dry-wet separation component is fixed to the base, the dry-wet separation component is capable of stretching and contracting in a direction perpendicular to the base, and the atomization component is not in communication with or is in communication with the e-liquid storage chamber along with the stretching and contracting of the dry-wet separation component.

In an embodiment, the dry-wet separation component is provided inside the e-liquid storage chamber, and the dry-wet separation component is adjacent to the spacer, the dry-wet separation component is provided with a second e-liquid guiding hole, the second e-liquid guiding hole is shielded or opened along with the stretching and contracting of the dry-wet separation component, such that the second e-liquid guiding hole is not in communication with or is in communication with the first e-liquid guiding hole.

In an embodiment, the e-liquid storage chamber is divided into a first e-liquid storage chamber and a second e-liquid storage chamber by the dry-wet separation component, the atomization component is in communication with the second e-liquid storage chamber through the first e-liquid guiding hole; the dry-wet separation component is provided with a second e-liquid guiding hole, the second e-liquid guiding hole is shielded or opened along with the stretching and contracting of the dry-wet separation component, such that the first e-liquid storage chamber is not in communication with or is in communication with the second e-liquid storage chamber.

In an embodiment, an inner wall of the e-liquid storage chamber is provided with a mounting part matching the dry-wet separation component and limiting a movement track of the dry-wet separation component.

In an embodiment, the dry-wet separation component includes a first limiting groove, a movable rod, and a sealing sleeve, the first limiting groove is provided on a surface of the inner wall of the e-liquid storage chamber and is located at a side portion of the mounting part, the movable rod and the sealing sleeve are both provided in the first limiting groove, the sealing sleeve is provided on a periphery of the movable rod, the second e-liquid guiding hole is provided on the movable rod, and the sealing sleeve is provided with an e-liquid outlet hole matching the second e-liquid guiding hole.

In an embodiment, one end of the movable rod adjacent to the mouthpiece is further provided with an exhaust hole, the sealing sleeve is provided with an e-liquid outlet hole matching the exhaust hole, the exhaust hole is not in communication with or is in communication along with the first e-liquid storage chamber and the second e-liquid storage chamber along with stretching and contracting of the movable rod.

In an embodiment, the movable rod is dumbbell-shaped, and a dumbbell-shaped grasping portion of the movable rod is located between the second e-liquid guiding hole and the exhaust hole.

In an embodiment, one end of the movable rod away from the mouthpiece is provided with one of a limiting protrusion and a second limiting groove, and the base is provided with the other one of the limiting protrusion and the second limiting groove, the limiting protrusion matches the second limiting groove.

The atomizer further includes a sealing element, the sealing element includes a sealing sleeve and a sealing seat, the sealing sleeve is provided in the first limiting groove, the sealing seat is embedded in the base, the sealing element seals a gap between the housing and the base and a gap between the e-liquid storage chamber and the dry-wet separation component.

An electronic cigarette includes a battery host and the above-mentioned atomizer, the atomizer is adapted to the battery host.

The above-mentioned atomizer and electronic cigarette at least include the following advantages.

The atomizer is provided with the dry-wet separation component inside the housing of the atomizer. As the dry-wet separation component moves along an axial direction of the base, it can be controlled whether the e-liquid storage chamber is in communication with or is not in communication with the atomization component. When the e-liquid storage chamber of the atomizer is pre-filled with e-liquid, and the atomizer is stored in a high-temperature environment or transported at a low pressure, the dry-wet separation component controls the atomization component to be not in communication with the e-liquid storage chamber, i.e., the atomization component is not in contact with the e-liquid in the e-liquid storage chamber, thereby avoiding that the e-liquid leaks through the atomization component and further flows to the outside of the atomizer through the air intake hole or the mouthpiece caused by increase of the pressure in the e-liquid storage chamber or decrease of the external pressure under the high-temperature environment or the external low pressure condition. When the atomizer is used, the dry-wet separation component moves to control the atomization component to be in communicate with the e-liquid storage chamber. Then high-temperature atomization can be carried out by the atomization component after the e-liquid is exported. The dry-wet separation component can effectively avoid the problem of leaking e-liquid from the atomizer during the high-temperature storage and low-pressure transportation, improve the user experience, and have a simple structure and a low cost.

DETAILED DESCRIPTION

In order to make the above objectives, features and advantages of the present disclosure clearer and more understandable, specific embodiments of the present disclosure will be described in detail below with reference to the accompanying drawings. Numerous specific details are set forth in the following description to facilitate a thorough understanding of the present disclosure. The present disclosure can be implemented in many other ways than those described herein, and those skilled in the art can make similar improvements without departing from the spirit of the present disclosure, thus the present disclosure is not limited by the specific embodiments disclosed below.

It should be noted that when an element is referred to as being "fixed" to another element, it may be directly on the other element or there may also be an intermediate element. When an element is considered to be "connected" to another element, it may be directly connected to another element or there may be an intermediate element at the same time.

Unless otherwise defined, all technical and scientific terms used herein have the same meaning as generally understood by those skilled in the art belonging to the present disclosure. The terms used herein in the specification of the present disclosure are for the purpose of describing specific embodiments only and are not intended to limit the present disclosure. The terms "and/or" as used herein include any and all combinations of one or more related listed items.

Figure 1:
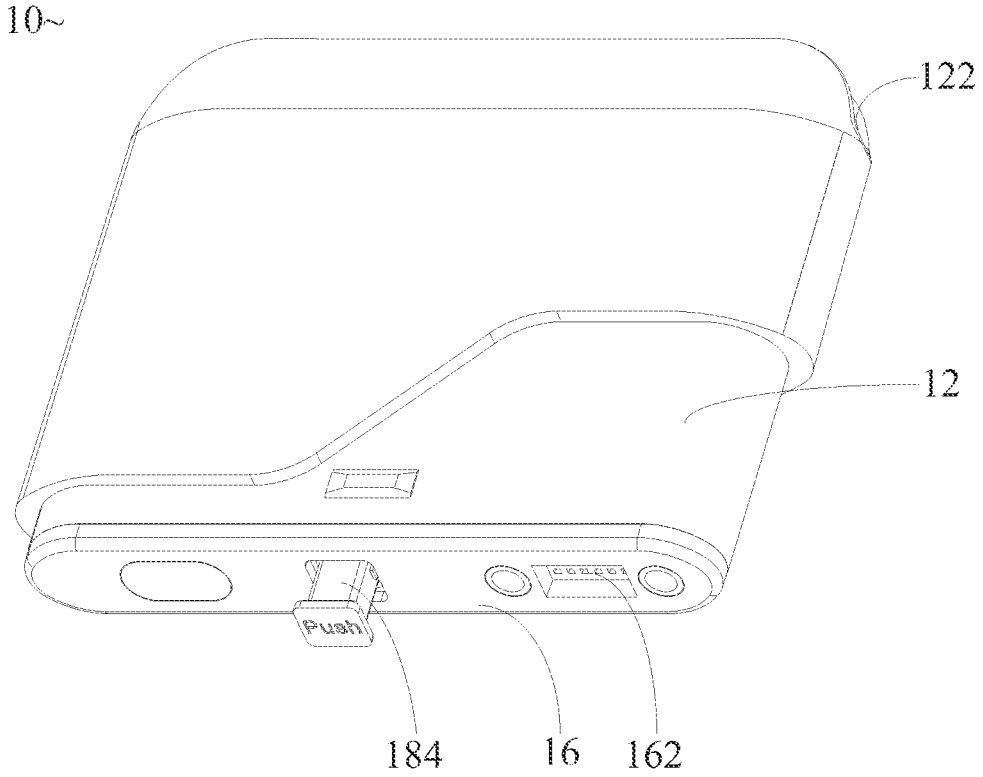
FIG. 1 is a schematic structure diagram of an atomizer according to an embodiment of the present disclosure.

Referring to FIG. 1, it is a block diagram of an atomizer 10 in one embodiment.

Figure 2:
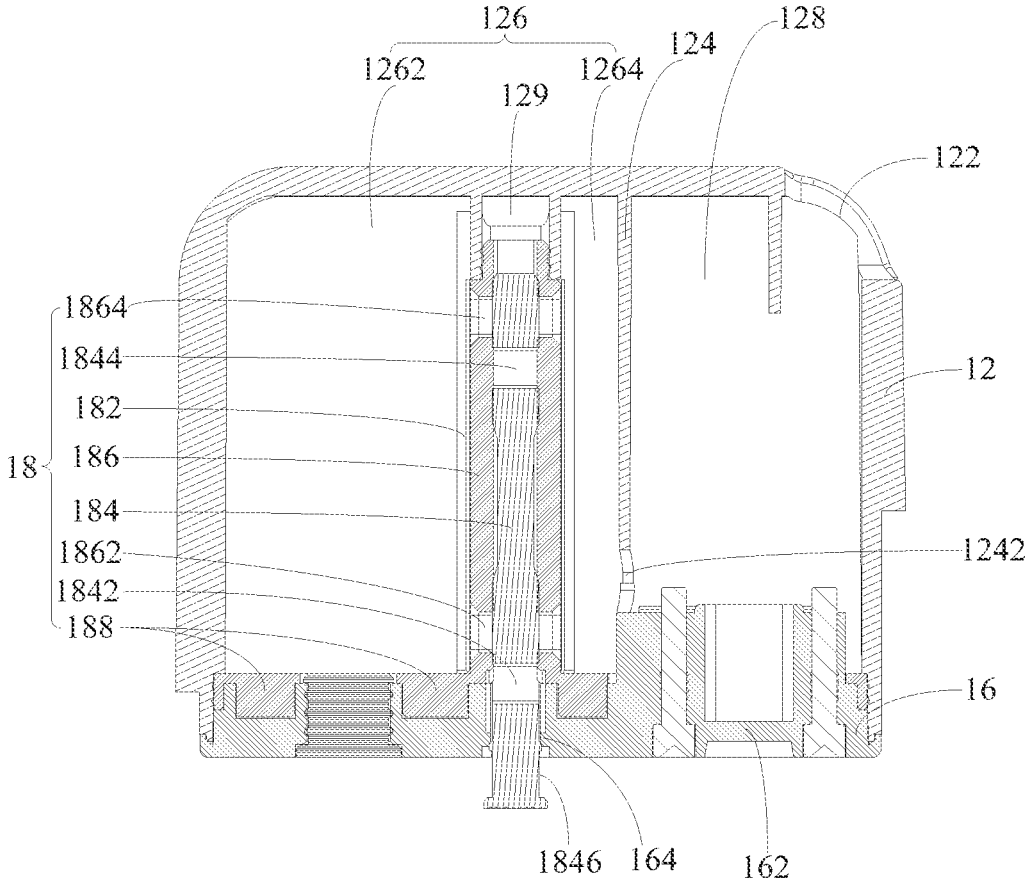
FIG. 2 is a cross-sectional view of an atomizer when a dry-wet separation component of the atomizer is located in a first position according to an embodiment of the present disclosure.
Figure 3:
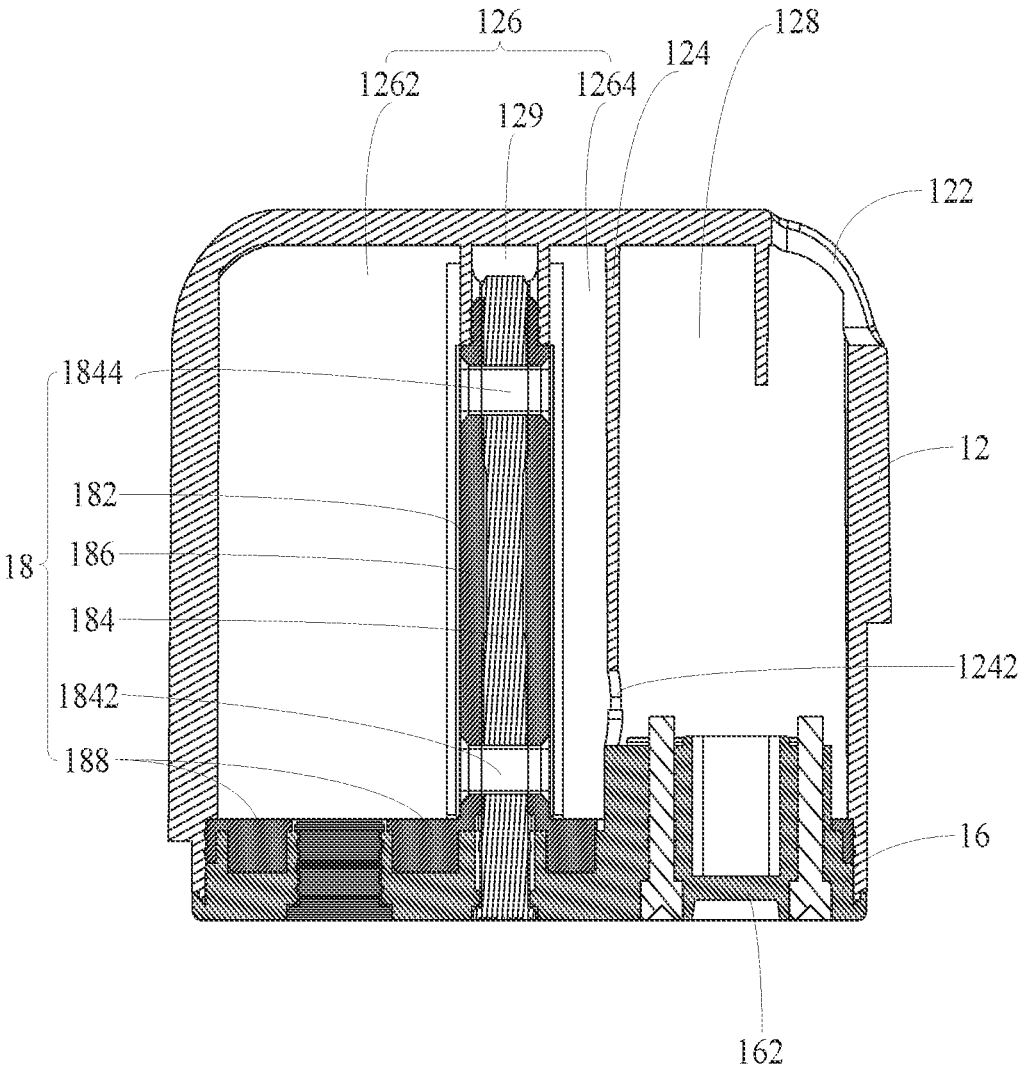
FIG. 3 is a cross-sectional view of an atomizer when a dry-wet separation component of the atomizer is located in a second position according to an embodiment of the present disclosure.
Figure 4:
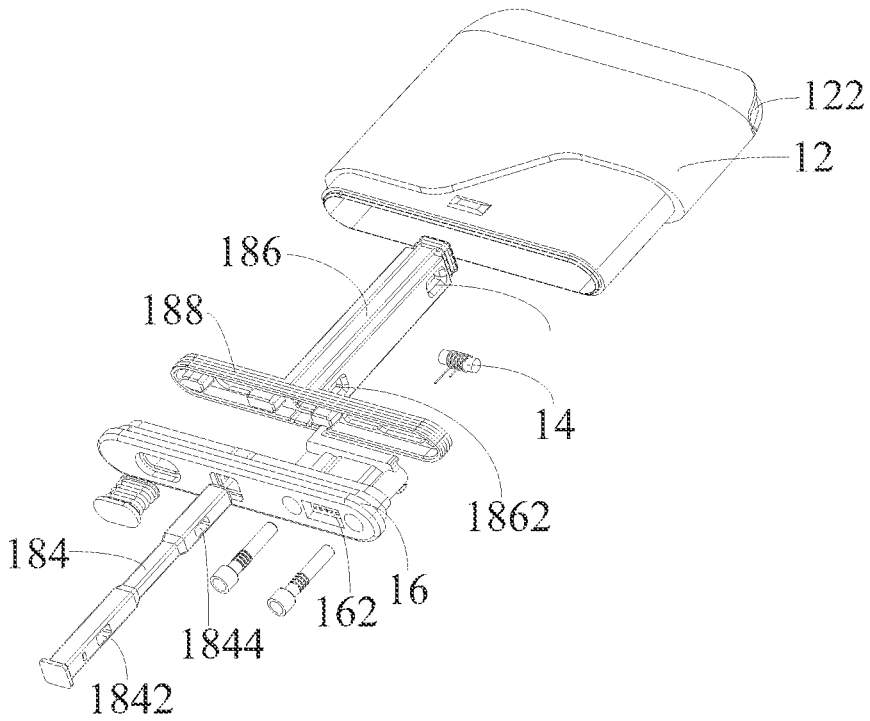
FIG. 4 is a schematic structural decomposition diagram of an atomizer according to an embodiment of the present disclosure.

Referring to FIG. 2 to FIG. 4, an atomizer 10 is a smoke generating device of an electronic cigarette. The atomizer 10 includes a housing 12, an atomization component 14 and a base 16. The housing 12 includes an opening end and a mouthpiece end 122. An interior of the house 12 is separated by a spacer 124 into a e-liquid storage chamber 126 and an atomization chamber 128. The base 16 is plugged into the opening end of the housing 12. The atomization component 14 is provided inside the atomization chamber 128. The spacer 124 is provided with a first e-liquid guiding hole 1242. The atomization component 14 is in communication with the first e-liquid guiding hole 1242. The housing 12 or the base 16 is provided with an air intake hole 162. The air intake hole 162, the atomization chamber 128, and the mouthpiece 122 are in communication with each other. When the electronic cigarette is in use, inhaling at the mouthpiece 122 can force external air to enter the atomization chamber 128 through the air intake hole 162. At the same time, the atomization component 14 is powered on and heats up. The atomization component 14 atomizes the e-liquid exported from the e-liquid storage chamber 126 through the first e-liquid guiding hole 1242 of the atomization component 14 at a high temperature. The e-liquid is atomized at the high temperature to form smoke, which can be smoked by the user.

Specifically, the atomizer 10 is provided with a dry-wet separation component 18. The dry-wet separation component 18 is provided inside the housing 12, and end of the dry-wet separation component 18 is fixed to the base 16. The dry-wet separation component 18 is capable of stretching and contracting in a direction perpendicular to the base 16. The atomization component 14 is blocked or in communication with the e-liquid storage chamber 126 with the stretching and contracting of the dry-wet separation component 18. That is, under a high-temperature storage or a low-pressure transportation or other environment conditions, when the e-liquid storage chamber 126 is pre-filled with the e-liquid, the e-liquid in the e-liquid storage chamber 126 may leak out via the atomization component 14 in communication with the e-liquid storage chamber 126 due to the external environment. At this time, referring to FIG. 2, the dry-wet separation component 18 is put in a first position, and the dry-wet separation component 18 is not in communication with the e-liquid storage chamber 126 to block a contact between the atomization component 14 and the e-liquid in the e-liquid storage chamber 126, thereby preventing the e-liquid from leaking out from the atomizer 10 via the atomization component 14. When the electronic cigarette is used, referring to FIG. 3, the dry-wet separation component 18 is put in a second position, and the dry-wet separation component 18 is in communication with the e-liquid storage chamber 126 to export the e-liquid in the e-liquid storage chamber 126 to the atomization component 14. After the atomizer 10 is connected to the battery host 20, inhaling at the mouthpiece 122 allows the high-temperature atomization for the user to smoke. The dry-wet separation component 18 can effectively prevent the e-liquid leak problem of the atomizer 10 during the high-temperature storage and low-pressure transportation, improve the user experience, and have a simple structure and a low cost.

In the present embodiment, stretching-contracting displacement of the dry-wet separation component 18 is calculated from a position of the dry-wet separation component 18 protruding from the base 16 to another position of the dry-wet separation component 18 aligned with the base 16. That is, the dry-wet separation component 18 can move from a first position in which the dry-wet separation component 18 protrudes from the base 16 to a second position in which the dry-wet separation component 18 is aligned with the base 16. The dry-wet separation component 18 protrudes from the base 16 when the atomization component 14 is not in communication with the e-liquid storage chamber 126. The dry-wet separation component 18 is aligned with the base 16 when the atomization component 14 is in communication with the e-liquid storage chamber 126. The dry-wet separation component 18 is pushed to be aligned with the base 16 when the atomizer 10 is used. In another embodiment, the stretching-contracting displacement of the dry-wet separation component 18 is calculated from a position of the dry-wet separation component 18 aligned with the base 16 to another position of the dry-wet separation component 18 recessed into the base 16. In an embodiment, the stretching-contracting displacement of the dry-wet separation component 18 is calculated from a position of the dry-wet separation component 18 protruding from the base 16 to another position of the dry-wet separation component 18 recessed into the base 16.

In the present embodiment, the dry-wet separation component 18 is provided inside the e-liquid storage chamber 126, and the dry-wet separation component 18 is adjacent to the spacer 124. The dry-wet separation component 18 is provided with a second e-liquid guiding hole 1842. The second e-liquid guiding hole 1842 is shielded or opened with the stretching and contracting of the dry-wet separation component 18, such that the second e-liquid guiding hole 1842 is in communication with or not in communication with the first e-liquid guiding hole 1242. That is, the dry-wet separation component 18 is provided to match the spacer 124, the e-liquid storage chamber 126 and the atomization chamber 128 are provided respectively at two sides of the dry-wet separation component 18. When the dry-wet separation component 18 is put in the first position, the first e-liquid guiding hole 1242 is staggered from the second e-liquid guiding hole 1842 to block the contact between the first e-liquid guiding hole 1242 and the e-liquid in the e-liquid storage chamber 126. When the dry-wet separation component 18 is put in the second position, the first e-liquid guiding hole 1242 is in communication with the second e-liquid guiding hole 1842. Accordingly, the atomization component 14 is in contact with the e-liquid in the e-liquid storage chamber 126 through the first e-liquid guiding hole 1242.

Preferably, referring again to FIGS. 2 and 3, when the e-liquid storage chamber 126 is larger, the e-liquid storage chamber 126 can be divided into a first e-liquid storage chamber 1262 and a second e-liquid storage chamber 1264 by the dry-wet separation component 18. The atomization component 14 is in communication with the second e-liquid storage chamber 1264 through the first e-liquid guiding hole 1242. The dry-wet separation component 18 is provided with a second e-liquid guiding hole 1842. The second e-liquid guiding hole 1842 is shielded or opened with the stretching and contracting of the dry-wet separation component 18, such that the first e-liquid storage chamber 1262 is not in communication with or in communication with the second e-liquid storage chamber 1264. That is, the dry-wet separation component 18 is provided in a middle portion of the e-liquid storage chamber 126 to divide the e-liquid storage chamber 126 into the first e-liquid storage chamber 1262 and the second e-liquid storage chamber 1264. In an initial state, the first e-liquid storage chamber 1262 stores e-liquid. The dry-wet separation component 18 is located in the first position to separate the first e-liquid storage chamber 1262 from the second e-liquid storage chamber 1264 which is an empty chamber. When the electronic cigarette is used, the dry-wet separation component 18 is located in the second position, And the first e-liquid storage chamber 1262 is in communication with the second e-liquid storage chamber 1264 through the second e-liquid guiding hole 1842. The e-liquid in the first e-liquid storage chamber 1262 flows into the second e-liquid storage chamber 1264, and is gradually exported by the atomization component 14 through the first e-liquid guiding hole 1242, such that the e-liquid can be atomized to form smoke for the user to smoke.

Further, referring to FIG. 4, one end of the dry-wet separation component 18 adjacent to the mouthpiece 122 is further provided with a first exhaust hole 1844. The first exhaust hole 1844 is not in communication with or in communication with the first e-liquid storage chamber 1262 and the second e-liquid storage chamber 1264 with the stretching and contracting of the dry-wet separation component 18. That is, when the dry-wet separation component 18 is located in the first position, both the second e-liquid guiding hole 1842 and the first exhaust hole 1844 are shielded, and the first e-liquid storage chamber 1262 is not in communication with the second e-liquid storage chamber 1264. When the dry-wet separation component 18 is located in the second position, the second e-liquid guiding hole 1842 and the first exhaust hole 1844 are both communicated, and the e-liquid in the first e-liquid storage chamber 1262 can flow out into the second e-liquid storage chamber 1264 through the second e-liquid guiding hole 1842. While, the air extrude by the increased e-liquid in the second e-liquid storage chamber 1264 is exhausted into the first e-liquid storage chamber 1262 through the first exhaust hole 1844, in such away, a circulation is formed, thereby facilitate the e-liquid in the first e-liquid storage chamber 1262 to flow into the second e-liquid storage chamber 1264 faster and more smoothly, making for shortening the time it takes the atomization component 14 to export the e-liquid before the atomizer 10 is used, and improving the smoking experience.

Of course, an inner wall of the housing 12 can provided with a member capable of shielding or opening the first exhaust hole 1844, such that the first exhaust hole 1844 and the second e-liquid guiding hole 1842 are synchronously blocked and communicated.

In particular, the dry-wet separation component 18 includes a first limiting groove 182, a movable rod 184, and a sealing sleeve 186. The first limiting groove 182 is provided on a surface of the inner wall of the e-liquid storage chamber 126. The movable rod 184 and the sealing sleeve 186 are both provided in the first limiting groove 182. The sealing sleeve 186 is provided on a periphery of the movable rod 184. The second e-liquid guiding hole 1842 is provided at one end of the movable rod 184 away from the mouthpiece 122, and the first exhaust hole 1844 is provided at one end of the movable rod 184 adjacent to the mouthpiece 122. The sealing sleeve 186 is provided with a e-liquid outlet hole 1862 matching the second e-liquid guiding hole 1842 and a second exhaust hole 1864 matching the first exhaust hole 1844. That is, when the movable rod 184 is located in the first position, the second e-liquid guiding hole 1842 is staggered from the e-liquid outlet hole 1862 in the sealing sleeve 186 and the first exhaust hole 1844 is staggered from the second exhaust hole 1864 in the sealing sleeve 186, respectively. When the movable rod 184 is located in the second position, the second e-liquid guiding hole 1842 is in communication with the e-liquid outlet hole 1862 in the sealing sleeve 186, and the first exhaust hole 1844 is in communication with the second exhaust hole 1864 in the sealing sleeve 186, respectively. The first limiting groove 182 is beneficial to limit a movement direction of the movable rod 184 within the housing 12. The sealing sleeve 186 is beneficial to maintain good sealing between the e-liquid storage chamber 126 and the movable rod 184. Thereby, the e-liquid or air is prevented from leaking through a gap between the movable rod 184 and the inner wall of the housing 12.

One end of the movable rod 184 away from the mouthpiece 122 and the base 16 are provided with a limiting protrusion 164 and a second limiting groove 1846 respectively, the limiting protrusion 164 matches the second limiting groove 1846. Specifically, the movable rod 184 is provided with the limiting protrusion 164, and the base 16 is provided with the second limiting groove 1846. Alternatively, the movable rod 184 is provided with the second limiting groove 1846, and the base 16 is provided with the limiting protrusion 164. The movement displacement of the movable rod 184 within a space enclosed by the base 16 and the housing 12 can be ensured, in order to prevent a problem that the movable rod 184 is pulled out of the base 16 or pushed too deep into the housing 12, which causes that the e-liquid guiding hole and the first exhaust hole 1844 fail to be not in communication with or to be in communication with the liquid storage chamber 126.

An inner wall of the e-liquid storage chamber 126 is further provided with a mounting part 129. The dry-wet separation component 18 matches the mounting part 129 and is located at a side portion of the mounting part 129. That is, one end of the movable rod 184 adjacent to the mouthpiece 122 is plugged into the mounting part 129, and one end of the sealing sleeve 186 is also plugged into the mounting part 129. A gap between the one end of the movable rod 184 and the mounting part 129 can limit a movement track of the dry-wet separation component 18.

In the present embodiment, the movable rod 184 is dumbbell-shaped, and a dumbbell-shaped grasping portion of the movable rod is located between the second e-liquid guiding hole 1842 and the first exhaust hole 1844. Because the outside of the movable rod 184 is in direct contact with the sealing sleeve 186, a greater resistance may be produced when the movable rod 184 moves. The movable rod 184 is designed to have a dumbbell-shaped structure with two thick ends and one thin middle portion, which is beneficial for reducing the resistance during the movement of the movable rod 184, such that it is easier to push the movable rod 184.

In the present embodiment, in addition to the sealing sleeve 186 provided between the movable rod 184 and the first limiting groove 182, a sealing seat 188 may be embedded in the base 16. The sealing seat 188 and the sealing sleeve 186 form a seal element of the atomizer 10. In addition, the sealing seat 188 and the sealing sleeve 186 may be combined in a T-shape. Of course, the sealing sleeve 186 and the sealing seat 188 can be separately formed and mounted, or the sealing seat 188 and the sealing sleeve 186 can be formed in one piece, such that the production and mounting part are more time-saving, labor-saving, and cost-saving. Specifically, the sealing seat 188 seals a gap between the housing 12 and the base 16, and the sealing sleeve 186 seals a gap between the e-liquid storage chamber 126 and the dry-wet separation component 18.

Apparently, an air intake hole 162 of the atomizer 10 may be provided on a side wall of the housing 12, or in the base 16. More preferably, a plurality of capillary holes are provided in the base 16 to form the air intake hole 162.

The atomization component 14 can include an e-liquid guiding cotton element and a heating coil wound around the e-liquid guiding cotton element. Alternatively, the atomization component 14 can include an e-liquid guiding ceramic element and a heating element attached to the e-liquid guiding ceramic element. Further alternative, the atomization component 14 can include a porous glass element and a heating element attached to the porous glass element, and so on.

An e-liquid injection hole can be provided on the side wall of the housing 12, and an e-liquid injection plug is provided to be adaptive to the e-liquid injection hole is. The e-liquid injection hole is in communication with the e-liquid storage chamber 126. Of course, in a case where the base 16 is large enough, the e-liquid injection hole and the e-liquid injection plug can also be provided in the base 16.

Figure 5:
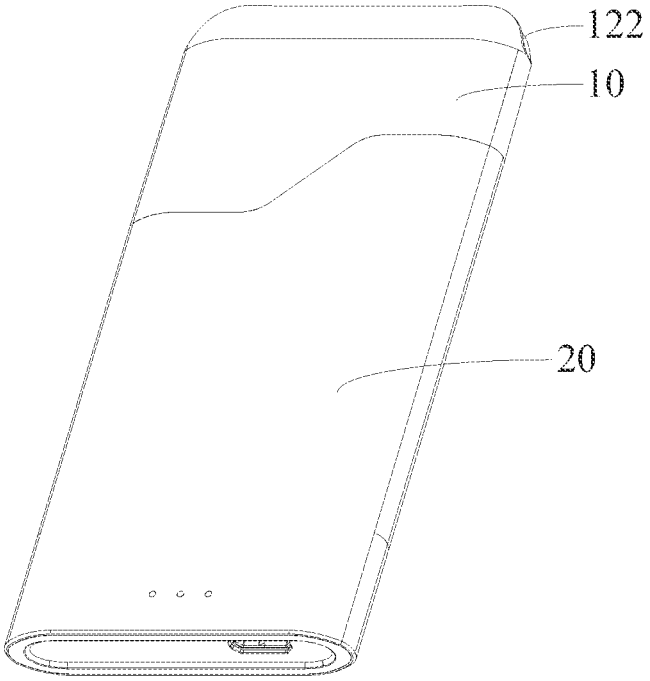
FIG. 5 is a schematic structure diagram of an electronic cigarette according to an embodiment of the present disclosure.

Referring to FIG. 5, the present disclosure also provides an electronic cigarette including an atomizer 10 and a battery host 20. The atomizer 10 is adapted to the battery host 20, and the atomizer 10 can be pluggable with the battery host 20 via a magnetic component or a snap component. The specific structure of the atomizer 10 can be understood with reference to the above-described embodiments. Since the present electronic cigarette employs all the technical solutions of all the above-described embodiments, it has at least all the advantages of the technical solutions of the above-described embodiments, which are not repeated here.

Specifically, the battery host 20 is a control center of the electronic cigarette. The battery host 20 of the electronic cigarette includes a housing, a support, a battery, a main control board, and an air pressure switch. The support, the battery, the main control board, and the air pressure switch are provided inside the housing. The main control board and the air pressure switch are both electrically connected to the battery. The main control board is provided with a conductive column and the atomization component 14 is provided with an electrode column. The conductive column is in contact with the electrode column to electrically connect the main control board to the atomization component 14. When the atomizer 10 is plugged into the main host, the electrode column is in contact with the conductive column to implement the electrical connection. The air pressure switch is turned on by inhaling at the mouthpiece 122, such that the atomizer 10 is powered by the battery host 20; and then the heating element is powered on and heats up to atomize the e-liquid for user to smoke.

Apparently, the main control board may be further provided with an external charge interface for charging the battery via a charge cable. The charge interface may be a USB interface or a Type-C interface, etc. Alternatively, the main control board is further provided with a wireless charge module electrically coupled to an external wireless charger. That is, the battery is charged through a wireless charge mode, so as to reduce the use of external cables.

The above-mentioned atomizer 10 and electronic cigarette include at least following advantages.

The atomizer 10 is provided with the dry-wet separation component 18 inside the housing 12 of the atomizer 10. As the dry-wet separation component 18 moves along an axial direction of the base 16, it can be controlled whether the e-liquid storage chamber 126 is in communication with or not in communication with the atomization component 14. When the e-liquid storage chamber 126 of the atomizer 10 is pre-filled with e-liquid, and the atomizer 10 is stored in a high temperature environment or transported at a low pressure, the dry-wet separation component 18 controls the atomization component 14 to be not in communication with the e-liquid storage chamber 126, i.e., the atomization component 14 is not in contact with the e-liquid in the e-liquid storage chamber 126, thereby avoiding that the e-liquid leaks through the atomization component 14 and further flows to the outside of the atomizer 10 through the air intake hole 162 or the mouthpiece 122 caused by increase of the pressure in the e-liquid storage chamber 126 or decrease of the external pressure under the high-temperature environment or the external low pressure condition. When the atomizer 10 is used, the dry-wet separation component 18 moves to control the atomization component 14 to be in communicate with the e-liquid storage chamber 126. Then high-temperature atomization can be carried out by the atomization component 14 after the e-liquid is exported. The dry-wet separation component 18 can effectively avoid the problem of leaking e-liquid from the atomizer 10 during the high-temperature storage and low-pressure transportation, improve the user experience, and have a simple structure and a low cost.

The various technical features of the above-described embodiments can be arbitrarily combined. For the sake of brevity of description, all possible combinations of the various technical features in the above-described embodiments are not described. However, as long as there is no contradiction in the combinations of these technical features, the combinations should be in the scope of the disclosure.

The above-described embodiments represent only several exemplary embodiments of the disclosure. The description of the embodiments is more specific and detailed, but are not therefore to be construed as limiting the scope of the disclosure. It should be noted that other modifications and improvements can be made by those of ordinary skill in the art without departing from the inventive concept, and all the modifications and improvements fall within the scope of the disclosure. Therefore, the scope of protection of the disclosure shall be subject to the appended claims.

What is claimed is:

1. An atomizer, comprising a housing, an atomization component and a base, the housing comprising an opening and a mouthpiece, an internal space of the housing being divided by a spacer into an electronic cigarette liquid (e-liquid) storage chamber and an atomization chamber, the base being plugged into the opening of the housing, the atomization component being provided inside the atomization chamber, the spacer being provided with a first e-liquid guiding hole, the atomization component being in communication with the first e-liquid guiding hole; wherein, the atomizer further comprises a dry-wet separation component provided inside the housing, one end of the dry-wet separation component is fixed to the base, the dry-wet separation component is capable of stretching and contracting in a direction perpendicular to the base, and the atomization component is not in communication with or is in communication with the e-liquid storage chamber along with the stretching and contracting of the dry-wet separation component.

2. The atomizer according to claim 1, wherein the dry-wet separation component is provided inside the e-liquid storage chamber, and the dry-wet separation component is adjacent to the spacer, the dry-wet separation component is provided with a second e-liquid guiding hole, the second e-liquid guiding hole is shielded or opened along with the stretching and contracting of the dry-wet separation component, such that the second e-liquid guiding hole is not in communication with or is in communication with the first e-liquid guiding hole.

3. The atomizer according to claim 1, wherein the e-liquid storage chamber is divided into a first e-liquid storage chamber and a second e-liquid storage chamber by the dry-wet separation component, the atomization component is in communication with the second e-liquid storage chamber through the first e-liquid guiding hole; the dry-wet separation component is provided with a second e-liquid guiding hole, the second e-liquid guiding hole is shielded or opened with the stretching and contracting of the dry-wet separation component, such that the first e-liquid storage chamber is not in communication with or is in communication with the second e-liquid storage chamber.

4. The atomizer according to claim 3, wherein an inner wall of the e-liquid storage chamber is provided with a mounting part matching the dry-wet separation component and limiting a movement track of the dry-wet separation component.

5. The atomizer according to claim 4, wherein the dry-wet separation component comprises a first limiting groove, a movable rod, and a sealing sleeve, the first limiting groove is provided on a surface of the inner wall of the e-liquid storage chamber and is located at a side portion of the mounting part, the movable rod and the sealing sleeve are both provided in the first limiting groove, the sealing sleeve is provided on a periphery of the movable rod, the second e-liquid guiding hole is provided on the movable rod, and the sealing sleeve is provided with an e-liquid outlet hole matching the second e-liquid guiding hole.

6. The atomizer according to claim 5, wherein one end of the movable rod adjacent to the mouthpiece is further provided with a first exhaust hole, the sealing sleeve is provided with a second exhaust hole matching the first exhaust hole, the exhaust hole is not in communication with or is in communication with the first e-liquid storage chamber and the second e-liquid storage chamber along with stretching and contracting of the movable rod.

7. The atomizer according to claim 6, wherein the movable rod is dumbbell-shaped, and a dumbbell-shaped grasping portion of the movable rod is located between the second e-liquid guiding hole and the exhaust hole.

8. The atomizer according to claim 7, wherein one end of the movable rod away from the mouthpiece is provided with one of a limiting protrusion and a second limiting groove, and the base is provided with the other one of the limiting protrusion and the second limiting groove, the limiting protrusion matches the second limiting groove.

9. The atomizer according to claim 4, further comprising a sealing element, wherein the sealing element comprises a sealing sleeve and a sealing seat, the sealing sleeve is provided in the first limiting groove, the sealing seat is embedded in the base, the sealing element seals a gap between the housing and the base and a gap between the e-liquid storage chamber and the dry-wet separation component.

10. An electronic cigarette, comprising a battery host and the atomizer according to claim 1, the atomizer being adapted to electrically connect to the battery host.

* * * * *